US005099748A

United States Patent [19]

Neubauer

[11] Patent Number: 5,099,748

[45] Date of Patent: Mar. 31, 1992

[54] PNEUMATIC SYSTEM FOR TELESCOPIC HOIST

[75] Inventor: Willibald Neubauer, Seattle, Wash.

[73] Assignee: Genie Industries, Inc., Redmond, Wash.

[21] Appl. No.: 522,242

[22] Filed: May 11, 1990

[51] Int. Cl.[5] ..... F15B 15/22; F01B 7/20

[52] U.S. Cl. ..... 91/26; 91/31; 91/168; 91/173; 91/176; 91/189 R; 91/407; 91/409; 92/52; 92/85 B

[58] Field of Search ..... 91/6, 31, 167 R, 168, 91/170 R, 173, 176, 178, 189 R, 392, 401, 419, 24, 25, 26, 27, 405, 406, 407, 408, 409; 92/51, 52, 85 R, 85 B

[56] References Cited

U.S. PATENT DOCUMENTS

| | | | |
|---|---|---|---|
| 165,472 | 7/1875 | Brickerhoff | 91/168 |
| 1,465,365 | 8/1923 | Ross | 92/52 X |
| 2,464,962 | 3/1949 | Bent | 91/26 |
| 3,188,917 | 6/1965 | Quayle | 91/168 |
| 3,415,169 | 12/1968 | Naddell | 92/85 B X |
| 3,534,659 | 10/1970 | Payson | 91/168 |
| 3,552,267 | 1/1971 | Bushnell | 91/168 |
| 3,808,946 | 5/1974 | Bell et al. | 91/168 |
| 3,838,625 | 10/1974 | Bell et al. | 91/168 |
| 4,088,061 | 5/1978 | Stoll et al. | 91/26 |
| 4,191,092 | 3/1980 | Farmer | 91/168 X |
| 4,397,218 | 8/1983 | Spring | 91/406 X |

FOREIGN PATENT DOCUMENTS

| | | | |
|---|---|---|---|
| 2900015 | 7/1980 | Fed. Rep. of Germany | 91/168 |
| 0030505 | 2/1983 | Japan | 91/167 R |
| 0113610 | 7/1983 | Japan | 91/168 |
| 0047709 | 9/1977 | U.S.S.R. | 92/51 |
| 0877869 | 9/1961 | United Kingdom | 91/168 |
| 1038620 | 8/1966 | United Kingdom | 92/52 |

*Primary Examiner*—Edward K. Look
*Assistant Examiner*—John Ryznic
*Attorney, Agent, or Firm*—Seed and Berry

[57] ABSTRACT

A telescopic pneumatic hoist has a flexible stationary hollow probe on its base arranged to unseat a check ball in the piston of the lowest intermediate stage when the piston is near the base. When such a condition exists, the probe closely interfits with the piston and has a radial port communicating with the underside of the piston. The probe connects at the bottom with a supply and exhaust passage which also communicates with the underside of the piston via a check valve controlled secondary passage.

7 Claims, 3 Drawing Sheets

PNEUMATIC SYSTEM FOR TELESCOPIC HOIST

TECHNICAL FIELD

This invention relates to a telescopic hoist of the general type shown in U.S. Pat. No. 3,552,267 wherein a portable telescopic mast carries a platform for supporting loads such, for example, as ceiling boards, ducts and insulation, at an adjustable working height.

BACKGROUND OF THE INVENTION

In hoists of the type to which the present invention is applicable, the intermediate and top telescopic stages each comprise a piston from which a cylinder extends upwardly to fit over the piston and cylinder of the next higher stage. The bottom stage has a stationary cylinder receiving the lowest intermediate stage. It is preferred to have the lowest intermediate stage be the first to move up and down during working height adjustments. To this end, some of the prior art hoists have an upwardly projecting hollow probe mounted at the bottom of the hoist through which the compressed air passes for raising and lowering the hoist. When the piston of the lowest intermediate stage approaches its lowered position, the probe extends through a passage in the piston and unseats a ball retained in the piston and normally functioning as a check valve to prevent air venting from the higher stages of the hoist. In the past, the probe has been rigid and given a working tolerance of about 0.007 inch with respect to the wall of the piston passage through which it extends to unseat the ball. This tolerance has been considered necessary in view of the normal radial tolerances between the telescopic elements of the hoist. In such prior art hoists, short erratic up and down movements have been experienced when the bottom stage is lowered to the point that the probe is in position to unseat the ball to vent the stages thereabove. The present invention aims to eliminate such erratic movements.

SUMMARY OF THE INVENTION

In accordance with the present invention, the probe is made flexible and the tolerance between the probe and the surrounding wall of the bottom piston when they interfit has been substantially reduced. It has been found that this change, together with providing a radial orifice in the probe exposed to the underside of the bottom, and providing a check valve permitting flow of incoming compressed air to the underside of the bottom piston, results in a smoothly operating hoist which does not have the previously experienced erratic motion. This improved result has been achieved because the present invention substantially eliminates air flow along the outside of the probe when it interfits with the bottom piston. Such air flow was discovered during the development of the present invention to be necessary for complete lowering of the bottom intermediate stage in the prior art hoists, and to also be the cause of the erratic hoist movement.

DETAILED DESCRIPTION OF THE INVENTION

Figure 1:
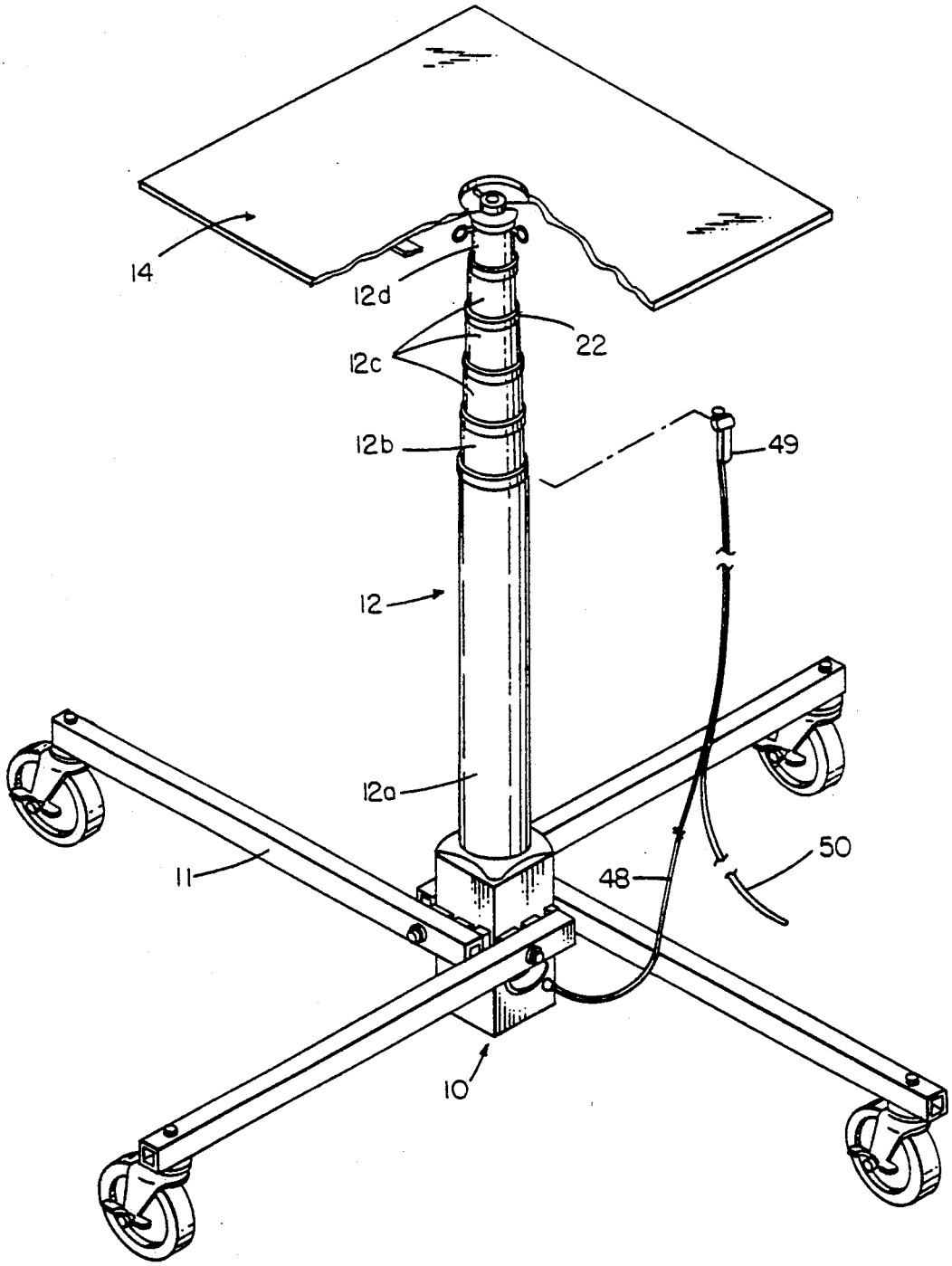
FIG. 1 is a perspective view of a typical hoist embodying the present invention.
Figure 2A:
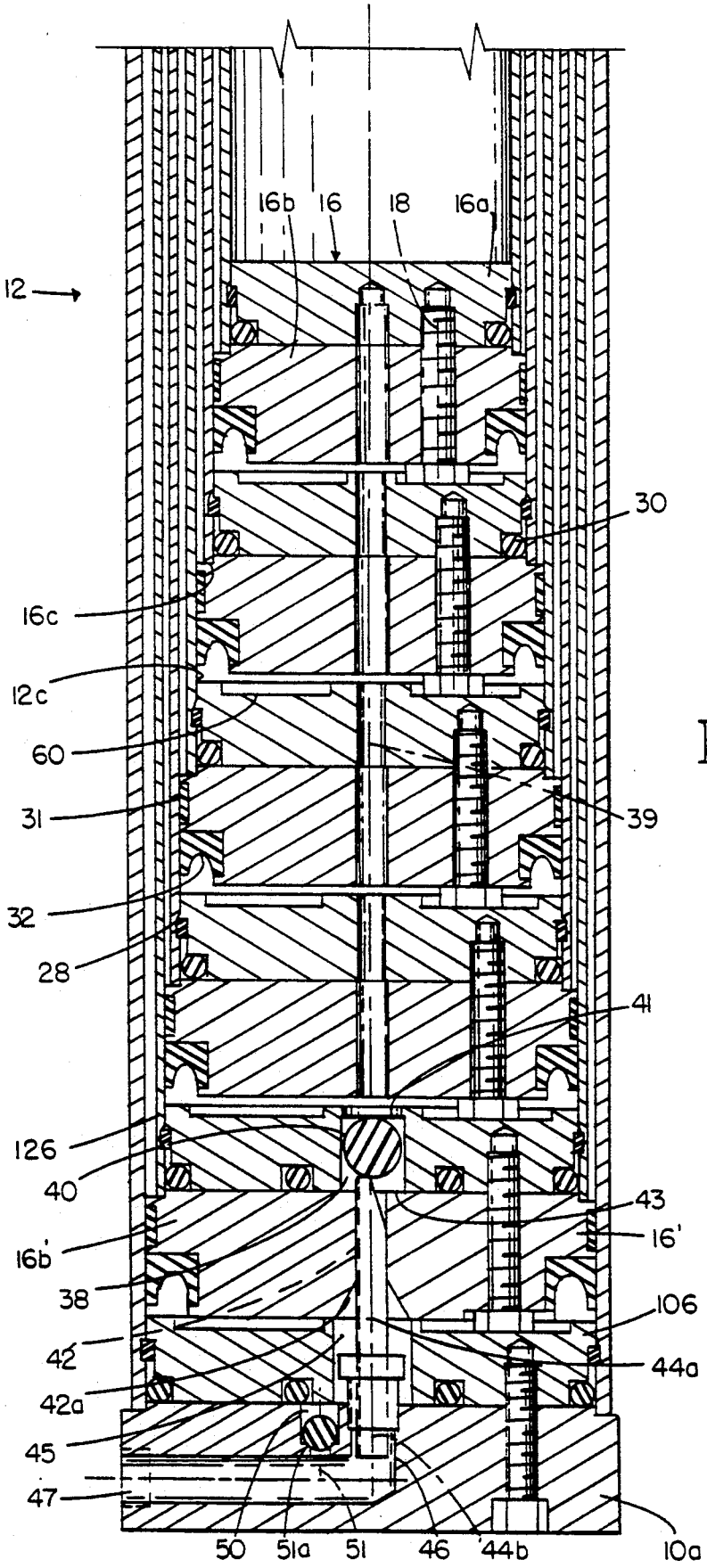
FIGS. 2*a* and 2*b* are fragmentary vertical sectional view through the telescopic mast of the hoist when in lowered condition.
Figure 2B:
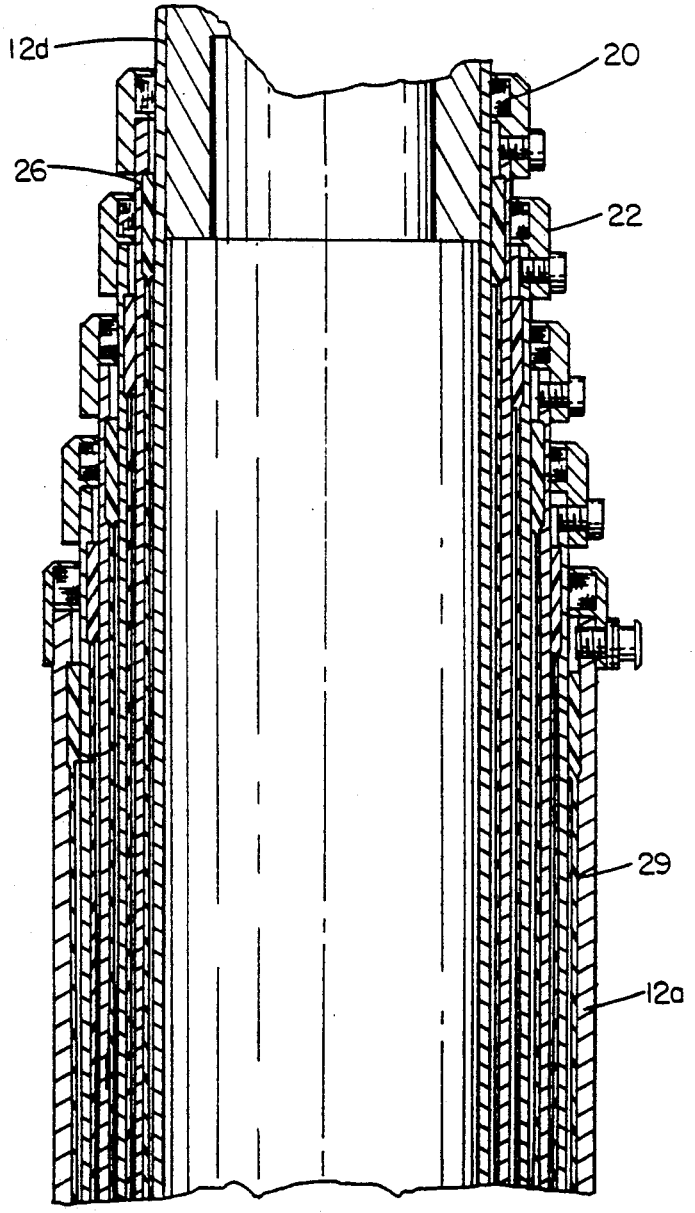

Referring to the drawings, the hoist has a base 10 fitted with outriggers 11, a mast assembly 12 mounted on the base 10, and a platform assembly 14 detachably mounted on the top of the mast assembly 12. The mast assembly has a bottom stationary stage having a cylinder 12*a* mounted in the base 10, a bottom intermediate cylinder 12*b*, several other intermediate cylinders 12*c*, and a top cylinder 12*d* on which the platform assembly 14 is mounted.

The cylinders 12*b–d* each have a bottom piston unit 16 formed by an upper piston element 16*a* and a lower piston element 16*b* held together by bolts 18. The various cylinders preferably have felt dust seals 20 at the top, held in position by retainers 22, each of which may be secured to a respective of the cylinders by radial set screws. Adjacent their upper ends, the cylinders 12*b*, 12*c* each have an annular recess receiving a guide ring 26 which is snap-fitted into place, and adjacent their lower ends each has an annular recess receiving a snap ring 28 functioning as a retainer to hold the piston units 16 against downward movement relative to the respective cylinders. Upward movement of the piston units 16 relative to the respective cylinders is prevented by engagement of the lower ends of the cylinders by a recessed shoulder 16*c* at the top of the lower piston elements 16*a*.

Stop sleeves 29 are located between the cylinders to restrict extension of each stage of the mast 12. Each sleeve 29 is of a length to engage at its upper end the lower edge of the overlying guide ring 26 presented by the cylinder on the outside of the sleeve, and to engage at its lower end the shoulder 16*c* of the underlying piston unit 16 when the cylinder on the inside of the sleeve is fully extended. Each piston unit 16 also has an outer O-ring 30 between the piston elements 16*a*–16*b*, a guide ring 31 at the periphery of the lower piston element 16*a*, and a peripheral U-cup 32 held in a bottom annular recess 16 in the lower piston element 16*b*.

The bottom stationary stage includes a lower base element 10*a* and an upper base element 10*b* in the base 10 which are held together by bolts 34 and have inner and outer O-rings 36, 37 therebetween. The upper piston element 16*a*′ on the bottom intermediate cylinder 12*b* has a central chamber 38 which houses a check ball 40 and has an upper ball retaining ring 41. The lower piston element 16*b*′ on cylinder 12*b* has a central passage 42 with a diameter less than that of the chamber 38 so as to provide an annular seat 43 for the ball 40. The piston units 16 of the intermediate cylinders 12*c* have aligned central air passages 39.

A flexible tubular probe 44, made for example from nylon tubing, is mounted at the center of the lower base element 10*a* and projects upwardly through an enlarged center passage 45 in the upper base elements 10*b*. The passage 42 is outwardly tapered at 42*a* to guide entry of the probe 44 therein. The remainder of the passage 42 has a clearance of only about 0.001 inches with respect to the probe so as to substantially restrict air flow past the outside of the probe when the probe occupies the passage 42. The upper end of the probe 44 is beveled so that air can pass through the probe when the probe engages and unseats the ball 40. In this regard, the probe 44 has a length such as to project into the chamber 38 sufficiently to unseat the ball 40 when the bottom movable piston 16′ is nearly in the fully lowered position. It will be noted that the probe 44 has a small radial port or orifice 44*a* opening into the bottom passage 45. This orifice is given a diameter of about 0.015 inches.

The probe 44 has a bottom mounting adaptor 44*b* which is threaded into the mouth of a central passage 46 in the bottom base element 10*a*. The lower end of the passage 46 is intersected by a radial passage 47 extending to an outer screw-in fitting for a hose 48 leading to a hand-held control unit 49 having an air supply hose 50 from a portable air compressor or a compressed air storage vessel mounted on the hoist. The control unit 49 contains a supply valve and a dump valve whereby compressed air can be selectively fed to the hoist for raising the platform 14 or exhausted from the hoist for lowering the platform.

As part of the present invention, the bottom base element 10*a* has a secondary passage 50 connecting the radial passage 47 with the bottom of the central passage 45 in the upper base element 10*b*. This secondary passage 50 is necked at the bottom to provide a seat 51*a* for a secondary check ball 51 housed in the passage 50. Whenever compressed air is supplied to the hoist, the ball 51 is raised to supply air directly from radial passage 47 to the underside of the bottom piston 16' via the passages 50 and 45. This arrangement assures that the bottom movable cylinder 12*b* will always raise first.

When the hoist is partially or fully extended and it is desired to downwardly adjust the elevation of the work platform 14, it is preferred to have the adjustment occur by lowering of the bottom cylinder 12*b*. This is assured because the ball 40 is then seated on the seat 43, and is not unseated by the probe 44 until the bottom piston element 16*b'* has nearly engaged the upper base element 10*b*.

The port 44*a* connecting the inside of the probe 44 with the surrounding area of the passage 45 assures continued adequate venting of the air from beneath the bottom piston 16' when the probe 44 has entered the restricted portion of the passage 42 during lowering of the hoist. Otherwise, the bottom piston 16' might not fully lower until the other pistons had lowered because the only escape path for the air trapped beneath the bottom piston 16' would be via the restricted space between the probe 44 and the surrounding wall of the passage 42.

When it is desired to raise the hoist, compressed air is introduced to the radial passage 47. This air passes inwardly through the probe and lifts the check ball 40, and also lifts the check ball 51 to introduce compressed air beneath the bottom piston 16'. The bottom intermediate cylinder 12*b* moves upwardly its full extent before the subsequent stages lift. The ball 40 remains unseated as long as the air introduction continues. When the air supply is cut off, the ball 40 seats and makes it impossible to lower the working platform relative to the bottom piston 16' until the bottom piston 16' has lowered to the level at which the probe 44 lifts the ball 45 from its seat 43. When the probe enters the piston passage 42 beneath the seat 43, air can continue to escape from beneath the bottom piston 16' through the port 45.

Making the probe 44 flexible permits the various cylinders 12 to adjust radially within tolerances substantially greater than the tolerance between the probe and the wall of passage 42 without damaging the probe, and thus permits the latter tolerance to be held small enough to substantially restrict air flow past the outside of the probe when the probe extends into passage 42. Such restriction is required to eliminate the erratic hoist movement previously experienced.

It is preferred to provide the upper faces of the upper base element 10*b* and the upper piston elements 16*a* with annular recesses 60 so that lubricating oil will always be retained at each stage of the hoist even if the hoist is laid on its side.

I claim:

1. A multi-stage hoist comprising:

a base assembly;

a plurality of concentric cylinders in telescopic upstanding relation including a stationary bottom cylinder mounted on said base assembly and having the largest cross-section, an intermediate cylinder, and a top cylinder having the smallest cross-section;

intermediate and top pistons mounted on the lower ends of said intermediate and top cylinders, respectively, said intermediate piston having a central passage therethrough;

a flexible hollow probe projecting upwardly from said base assembly and arranged to project into said central passage when said intermediate piston is adjacent said base assembly;

a primary check valve in said central passage which is normally closed when said intermediate piston is raised, and which is opened by said probe when said intermediate piston is close to said base assembly;

a radial port in said probe always exposed to communication with the underside of said intermediate piston;

a primary air passage in said base assembly exposed to the inside of said probe;

a secondary air passage in said base assembly exposed to the underside of said intermediate piston; and a normally closed secondary check valve in said secondary air passage arranged to open responsive to introduction of pressurized fluid to said passages to extend the hoist.

2. A hoist according to claim 1 in which said probe closely interfits with said intermediate piston when the latter is adjacent said base assembly.

3. A hoist according to claim 1 in which said primary check valve includes a ball arranged to be lifted from a seat in said central passage by said probe.

4. A hoist according to claim 1 in which said primary and secondary check valves include respective balls arranged to be lifted from seats in said central passage and secondary passage when pressurized fluid is introduced to said primary passage for extending the hoist.

5. In a pneumatic telescopic mast of the type having a base, a stationary upstanding base cylinder on said base, and an intermediate stage with a piston and cylinder slidably mounted in said base cylinder:

a hollow air supply and exhaust probe projecting from said base and arranged to closely interfit with said piston when the latter is in lowered position;

a ball check in said piston arranged to be lifted to an open position by said probe;

a port in said probe arranged to communicate with the underside of said piston;

a supply and exhaust passage in said base to the inside of said probe; and a check valve controlled secondary passage in said base for primary supply of air to the underside of said piston when said probe interfits with said piston.

6. In a telescopic mast in accordance with claim 5, said probe being flexible to adjust for radial tolerances between said cylinders.

7. In an telescopic mast in accordance with claim 6, said interfit between said probe and said piston having a tolerance of about 0.001 inches.

* * * * *